US011357337B2

(12) United States Patent
Dolk et al.

(10) Patent No.: US 11,357,337 B2
(45) Date of Patent: Jun. 14, 2022

(54) BABY CARRIER WITH ADJUSTABLE HEAD SUPPORT AND BUCKLE THEREFORE

(71) Applicant: BABYBJÖRN AB, Solna (SE)

(72) Inventors: Jonas Dolk, Dalarö (SE); Mårten Andrén, Spånga (SE); Ulrika Vejbrink, Hägersten (SE); Henrik Andersson, Reftele (SE); David Karpathakis Thalén, Bromma (SE); Lisen Elmberg, Stockholm (SE)

(73) Assignee: BABYBJÖRN AB, Solna (SE)

( * ) Notice: Subject to any disclaimer, the term of this patent is extended or adjusted under 35 U.S.C. 154(b) by 193 days.

(21) Appl. No.: 16/771,827

(22) PCT Filed: Nov. 29, 2018

(86) PCT No.: PCT/SE2018/051231
§ 371 (c)(1),
(2) Date: Jun. 11, 2020

(87) PCT Pub. No.: WO2019/117781
PCT Pub. Date: Jun. 20, 2019

(65) Prior Publication Data

US 2021/0186234 A1 Jun. 24, 2021

(30) Foreign Application Priority Data

Dec. 14, 2017 (SE) ..... 1751550-3

(51) Int. Cl.
*A47D 13/02* (2006.01)
*A44B 11/06* (2006.01)

(52) U.S. Cl.
CPC ..... *A47D 13/02* (2013.01); *A44B 11/06* (2013.01)

(58) Field of Classification Search
CPC ..... A47D 13/02; A47D 13/025; A44B 11/06
See application file for complete search history.

(56) References Cited

U.S. PATENT DOCUMENTS

D507,102 S * 7/2005 Bergkvist ..... A47D 13/025 D3/214
8,225,970 B2 * 7/2012 Ventrola ..... A44B 11/26 24/318

(Continued)

FOREIGN PATENT DOCUMENTS

JP 10117896 5/1998
JP 2015209595 11/2015

(Continued)

*Primary Examiner* — Justin M Larson
(74) *Attorney, Agent, or Firm* — Duane Morris LLP; Gregory M. Lefkowitz

(57) ABSTRACT

The invention relates to a baby carrier comprising chest straps, which are arranged to extend around both shoulder regions of a wearer, a waist belt, and a baby-carrying pouch mounted on the chest straps and the waist belt, said baby-carrying pouch comprises at least a front piece having leg openings and a head support, respective lateral corner of the head support being detachably connected to corresponding nearby connecting point at respective chest strap by a first strap means having a detachable buckle. A second strap means is arranged between respective lateral corner of the head support and a buckle slidably arranged along respective first strap means, and that said second strap means is continuously adjustably connected said buckle.

13 Claims, 7 Drawing Sheets

(56) References Cited

U.S. PATENT DOCUMENTS

| | | | | |
|---|---|---|---|---|
| 8,490,844 | B2 * | 7/2013 | Favorito | A47D 13/025 224/159 |
| D714,045 | S * | 9/2014 | Stave | D3/214 |
| 9,138,071 | B2 * | 9/2015 | Larch | A47D 13/025 |
| D807,025 | S * | 1/2018 | Elmberg | D3/214 |
| 10,076,194 | B2 * | 9/2018 | Wikner | A47D 13/025 |
| 10,271,663 | B2 * | 4/2019 | Salazar | A47D 13/025 |
| D851,916 | S * | 6/2019 | Andersson | D3/214 |
| 10,349,754 | B2 * | 7/2019 | Kang | A47D 13/025 |
| 10,426,275 | B2 * | 10/2019 | Telford | A47D 13/025 |
| D886,667 | S * | 6/2020 | Andersson | D11/216 |
| 11,026,520 | B2 * | 6/2021 | Fan | A47D 13/025 |
| 11,039,695 | B2 * | 6/2021 | Fan | A47D 13/025 |
| D930,976 | S * | 9/2021 | Andersson | D3/214 |
| 11,202,520 | B2 * | 12/2021 | Musiiwa | A47D 13/025 |
| 2004/0020951 | A1 * | 2/2004 | Bergkvist | A47D 13/025 224/160 |
| 2012/0217273 | A1 * | 8/2012 | Gunter | A47D 13/025 224/159 |
| 2016/0150893 | A1 * | 6/2016 | Salazar | A47D 13/025 224/160 |
| 2020/0268169 | A1 * | 8/2020 | Telford | A47D 13/025 |
| 2021/0093098 | A1 * | 4/2021 | Ross | A47D 15/00 |
| 2021/0378418 | A1 * | 12/2021 | Telford | A47D 13/025 |
| 2021/0393049 | A1 * | 12/2021 | Telford | A47D 15/006 |

FOREIGN PATENT DOCUMENTS

| | | |
|---|---|---|
| KR | 20120005148 | 7/2012 |
| KR | 101716580 | 3/2017 |
| SE | 1551152 | 3/2017 |

* cited by examiner

BABY CARRIER WITH ADJUSTABLE HEAD SUPPORT AND BUCKLE THEREFORE

CROSS-REFERENCE TO RELATED APPLICATIONS

This application is a § 371 national stage entry of International Application No. PCT/SE2018/051231, filed Nov. 29 2018, which claims priority of Sweden National Application No. 1751550-3, filed Dec. 14, 2017, the entire contents of which are incorporated herein by reference.

FIELD OF THE INVENTION

The present invention relates to a baby carrier with adjustable head support of the kind defined in the preamble of claim 1 and a buckle for enabling the adjustment of the head support according to claim 8.

BACKGROUND OF THE INVENTION

A baby carrier usually comprises a harness having chest straps arranged to extend around both shoulder regions of the wearer, a waist belt and a front piece which is carried by the harness and the waist belt and which forms a baby-carrying pouch or at least a part of said baby-carrying pouch.

At least the upper lateral corner portions of the front piece, i.e. the upper lateral corners of a head support, are preferably detachably connected to corresponding nearby connecting points of the harness/chest straps. Also, other part/parts of the front piece may be detachably connected to corresponding connecting points of the harness either directly or via strap means, for instance.

A baby carrier having a front piece of the above-mentioned type is disclosed in Applicant's International Patent Application WO 2015/053696, for instance, which is hereby incorporated by reference.

The front piece is made of a flexible material and therefore shapes itself to at least some extent under the influence of the shape and weight of the baby carried by the baby-carrying pouch.

Moreover, the head support is normally adjustably attached to the respective chest strap of the harness by strap means, the length of which is adjustable so as to be able to adjust the distance between the head of baby/child carried and the chest of the wearer of the baby carrier, i.e. the more the strap means are tightened the closer to the chest the head of the baby/child will be.

It is also desirably to be able to fold the head support to a folded position, i.e. the head support may be folded downwardly along and on the outside of the front piece. Depending upon the position of the child carried by the baby carrier, i.e. when the child is carried in a face forward position, the head support will be situated in front of the face of the baby/child carried, and thus should preferably be fold to a folded position for the convenience of the baby/child.

To enable the head support to take the folded position it is known to provide the head support with a longitudinal stiffening means extending from an upper border edge of the head support to a position of the front piece where the head support is to be folded. With this solution the head support can only take either of two positions, the upright position or the folded position. A drawback with this solution is that the head support may unintentionally turn from the folded position to the upright position by the springingly action of the stiffening means.

One way of eliminating the above-mentioned drawback of the head support is disclosed in Applicant's Swedish patent SE 539460 C2, which is hereby incorporated by reference and in which one continuously adjustable strap is provided. More particularly, one end of said strap is attached to the front piece and the other end of said strap is adjustably connected via a buckle to the head support or vice versa.

Both of the above-mentioned solutions of folding the head support are made in a two-dimensional direction.

An object of the present invention is to provide a baby carrier having a front piece with a head support which can be adjusted in several ways and which enables continuous adjustment both in height and towards and away from the wearer of the baby carrier, thus in three dimensions.

A reason why the adjustment of the head support should be improved is that one and the same baby carrier should be able to be adaptable to the size of the baby/child as it grows.

According to the invention, this object is achieved by a baby carrier comprising chest straps, which are arranged to extend around both shoulder regions of a wearer, a waist belt, and a baby-carrying pouch mounted on the chest straps and the waist belt, said baby-carrying pouch comprises at least a front piece having leg openings and a head support, respective lateral corner of the head support being detachably connected to corresponding nearby connecting point at respective chest strap by a first strap means having a detachable buckle, characterized in that a second strap means is arranged between respective lateral corner of the head support and a buckle slidably arranged along respective first strap means, and that said second strap means is continuously adjustably connected said buckle.

Other embodiments of the invention will be apparent from the accompanying dependent claims.

BRIEF DESCRIPTION OF DRAWINGS

The invention will now be described by way of a non-limiting example with reference to the accompanying drawing, in which.

DESCRIPTION OF PREFERRED EMBODIMENTS

In the description and claims below expressions such as upper, lower, downwardly etc. are to be understood in connection with the normal use of the baby carrier as carried by a wearer.

It should be noted that the expression baby and child is interchangeable with each other throughout the description and claims.

Figure 1:
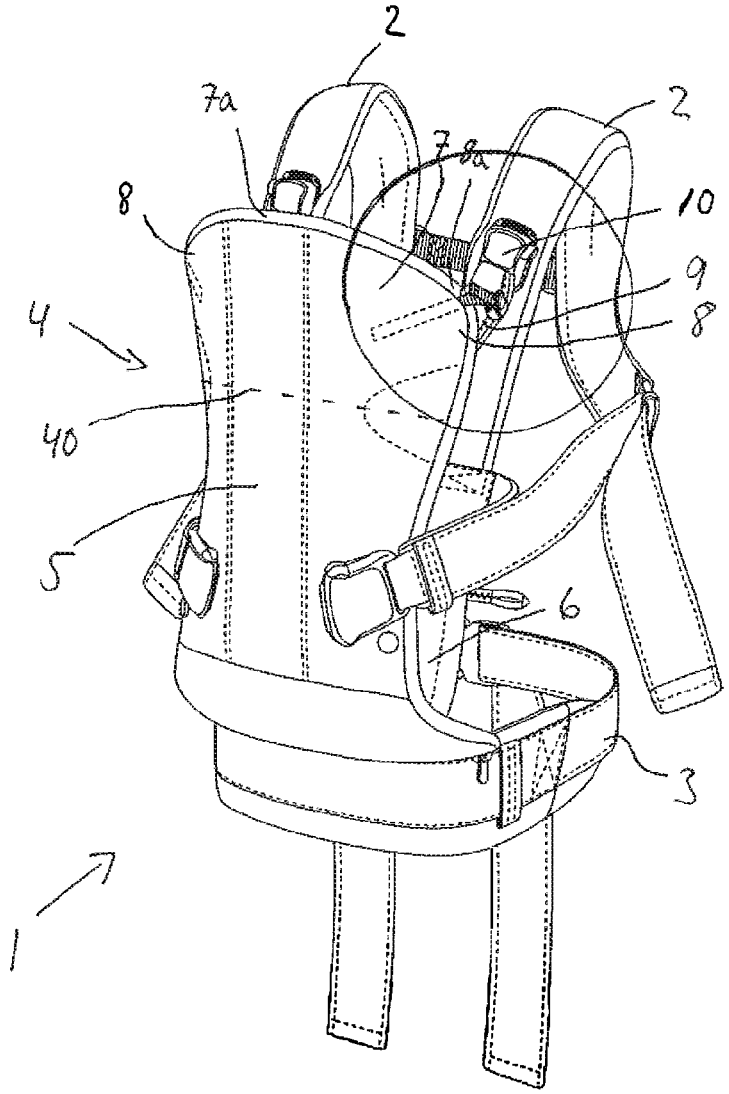
FIG. 1 is a perspective view of a baby carrier with a front piece having a head support with adjustment means and with the head support shown in an upright position.

FIG. 1 shows a baby carrier 1 comprising chest straps 2, which are arranged to extend around both shoulder regions of a wearer (not shown), a waist belt 3, and a baby-carrying pouch 4 mounted on the chest straps and the waist belt. The baby-carrying pouch 4 comprises at least a front piece 5 having leg openings 6 and a head support 7. Respective lateral corner 8 of the head support 7 is detachably connected to corresponding nearby connecting point at respective chest strap 2 by a first strap means 9 (see FIG. 2) having a detachable buckle 10.

Figure 2:
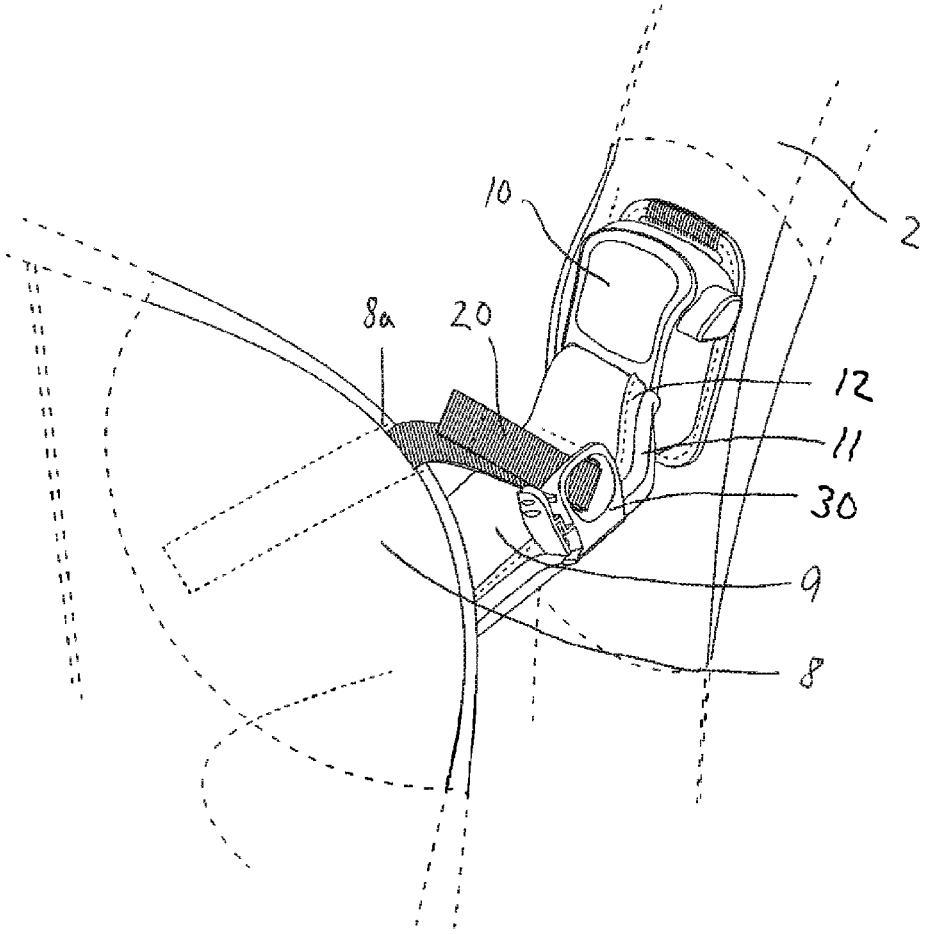
FIG. 2 is an enlarged view of the adjustment means within the circle of FIG. 1.

As seen in more detail in FIG. 2, a second strap means 20 is arranged between a border portion 8*a* of respective lateral corner 8 of the head support 7 and a buckle 30 slidably arranged along respective first strap means 9. The second strap means 20 is continuously adjustably connected to said buckle 30.

More particularly, the first strap means 9 is preferably formed as a rectangular padded strap and provided with a braid 11 along an edge 12 of the first strap means 9. The braid 11 is arranged along the edge 12 of the first strap means 9 directed away from a central portion of the baby carrier 1, i.e. on the outside edge 12 of respective first strap means 9.

Figure 3:
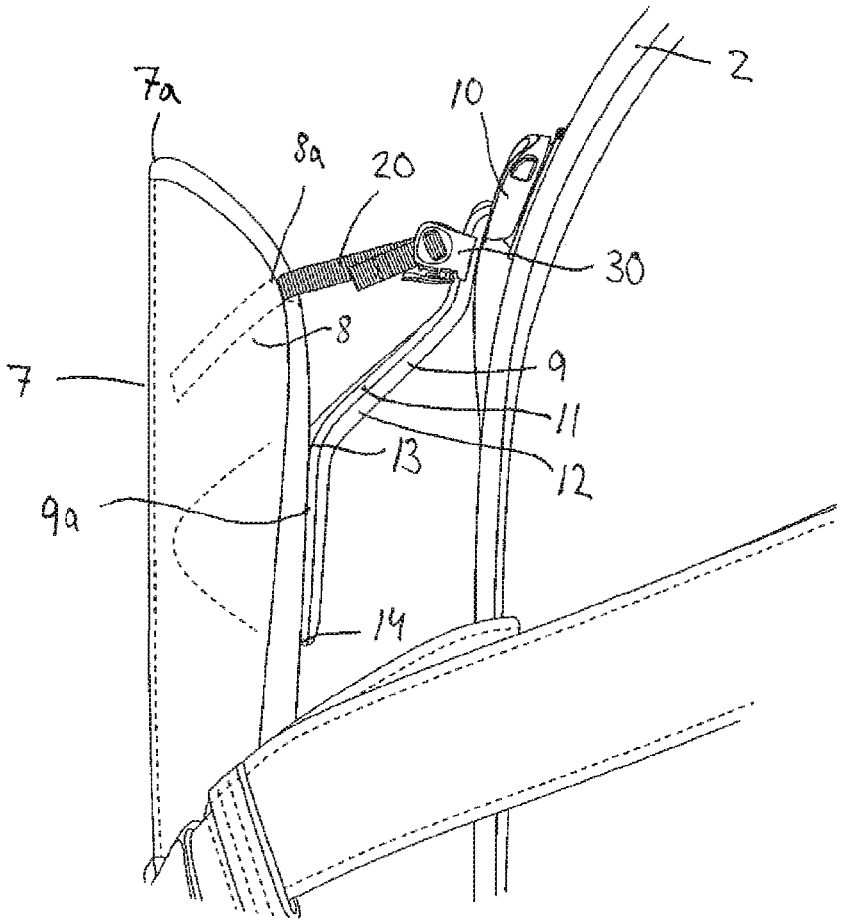
FIG. 3 is a partial side view of the baby carrier shown in FIG. 1 showing the head support in a upright position with a buckle of a second strap means in an upper position.

As seen in FIG. 3, the first strap means 9 is attached at its end 9*a* opposite to said detachable buckle 10 to the head support 7 in such a way that at least an upper attachment point 13 and a lower attachment point 14 are formed, and the braid 11 stretches along the edge 12 of the first strap means 9 all the way from the detachable buckle 10 to the lower attachment point 14. Thus, the buckle 30 can slide from the detachable buckle 10 to the lower attachment point 14 or vice versa and may by arrested at any point along the braid 11.

The attachment of the end 9*a* of the respective first strap means 9 to the inside of the front piece 5 can be made in any suitable way as long as the buckle 30 can slide along the braid 11 from the detachable buckle 10 to the lower attachment point 14 of the first strap means 9 or vice versa.

Figure 4:
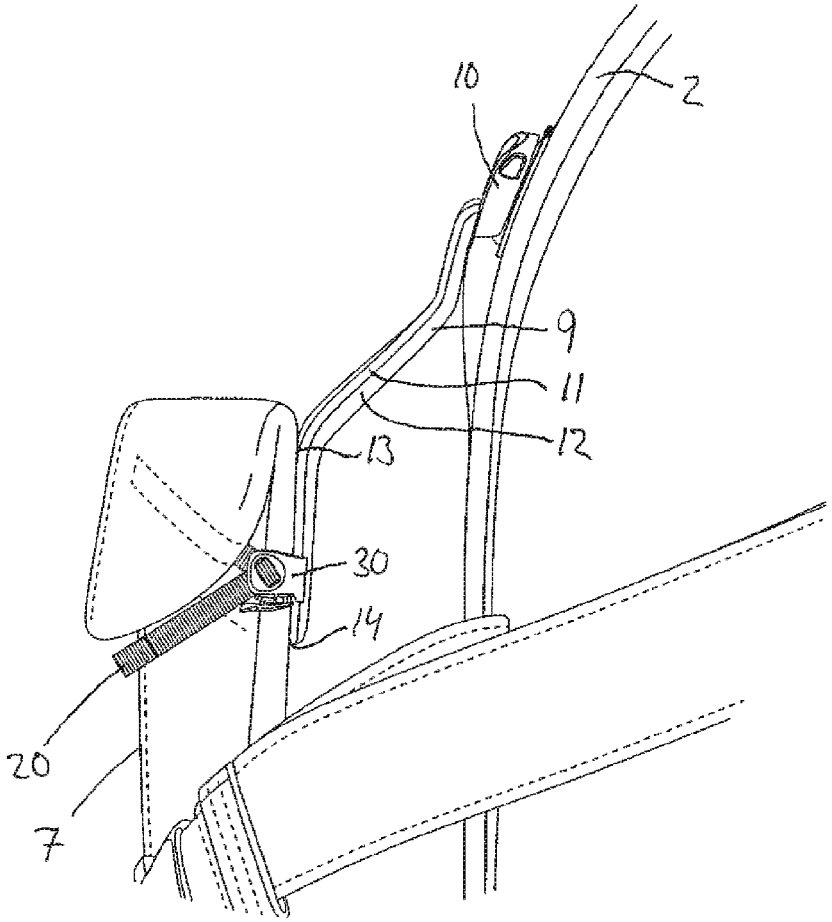
FIG. 4 is a view similar to the one shown in FIG. 3 showing the head support in a folded position with the buckle of the second strap means in a lower position.

Of the front piece 5 at least the head support 7 is formed of a padded material, and the head support 7 is provided with a stiffening means (not shown) arranged between an upper border edge 7*a* of the head support 7 and an imaginary line 40 formed normal to the longitudinal direction of the front piece 5 and positioned in line with the respective upper attachment points 13 or between the respective upper attachment points 13 and the respective lower attachment points 14 and acting as a line along which the head support 7 may be folded to its folded position. See FIG. 4.

To increase the possibilities of adjustment of the head support 7 the buckle 30 is provided with a locking tongue 32 (see FIG. 5) arranged to lock the buckle 30 at any point along the braid 11, and also the second strap means 20 is continuously adjustably connected said buckle 30. This means that an adjustment of the head support 7 can be made in three dimensions.

The buckle 30 with its locking tongue 32 will be described in more detail below.

Figure 5:
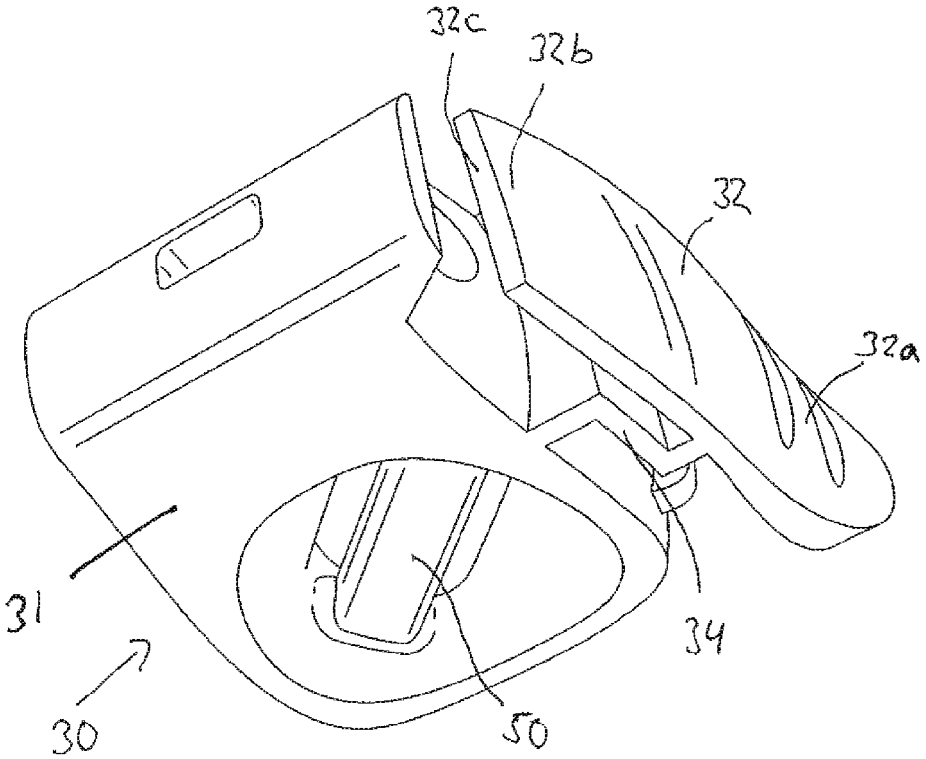
FIG. 5 is a view obliquely from above of a buckle for enabling adjustment of the head support.
Figure 6:
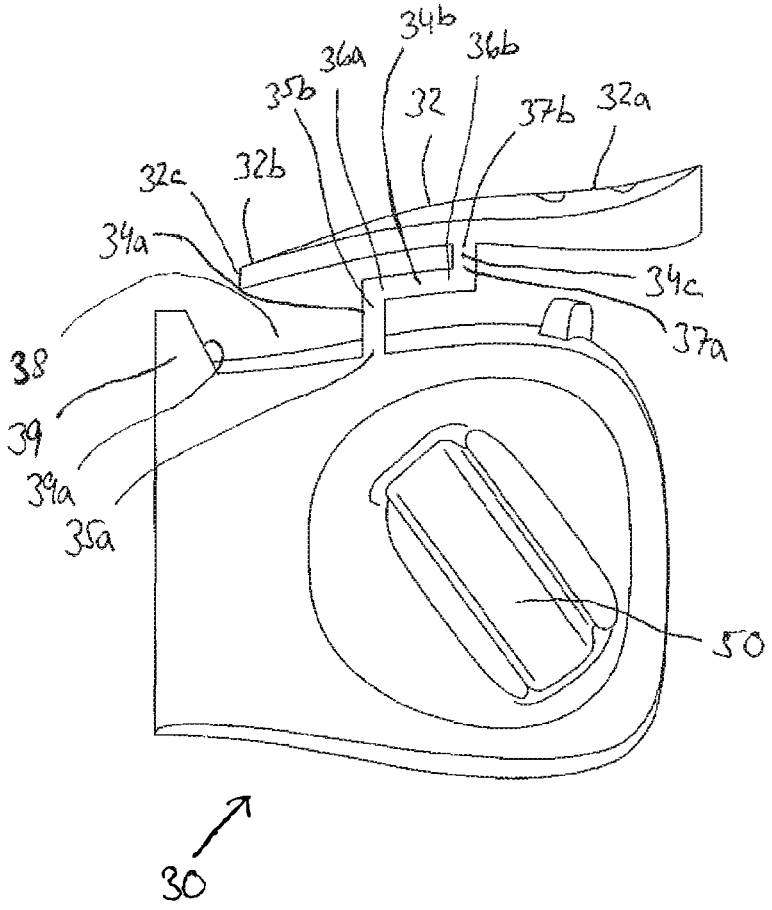
FIG. 6 is a front view of the buckle shown in FIG. 5.
Figure 7:
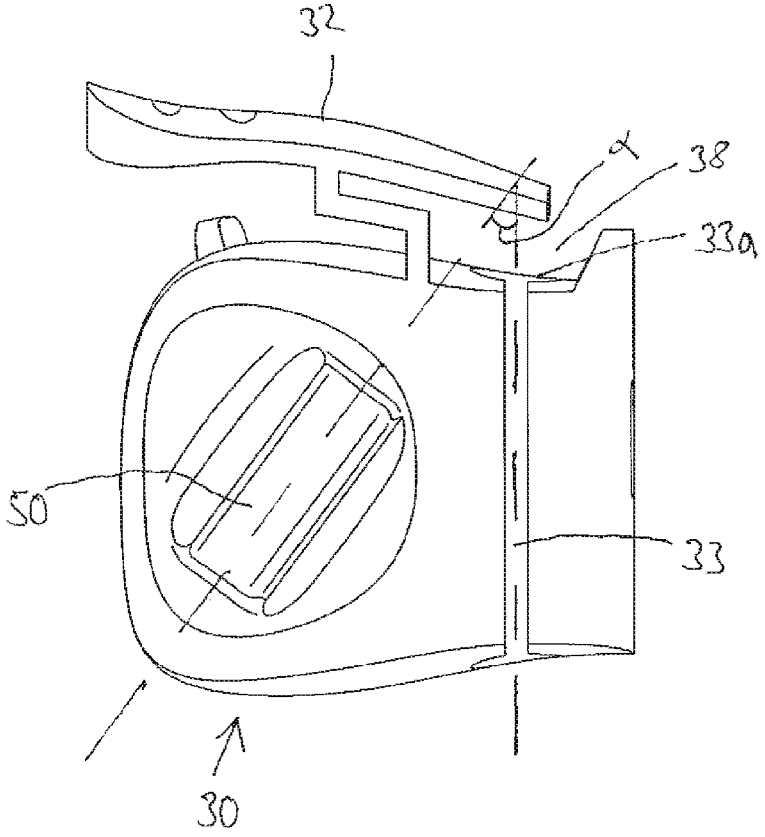
FIG. 7 is a rear view of the buckle shown in FIG. 6.

As shown in FIGS. 5-7, the buckle 30 comprises a body 31 provided with a locking tongue 32 having a key portion 32*a*, a pin 50 around which the second strap means 20 is threaded (see FIG. 3, for instance) and which enables continuous adjustment of the length of the second strap means 20, and an open grove 33 in which the braid 11 is arranged to run. The locking tongue 32 is springingly attached to the body 31 by a spring means 34 having three interconnected leg portions, a first leg portion 34*a*, a second leg portion 34*b*, and a third leg portion 34*c*, arranged perpendicular relative to each other in such a way the first leg portion 34*a* and the third leg portion 34*c* is arranged parallel to each other.

More particularly, a first end 35*a* of the first leg portion 34*a* is attached to the body 31 and a second end 35*b* of the first leg portion 34*a* is attached to a first end 36*a* of the second leg portion 34*b*. A second end 36*b* of the second leg portion 34*b* is attached to a first end 37*a* of the third leg portion 34*c* and a second end 37*b* of the third leg portion 34*c* is attached to the locking tongue 32, preferably at a middle portion thereof.

An end 32*b* of the locking tongue 32 opposite to the key portion 32*a* has a flat surface 32*c* preferably arranged in parallel with the first leg portion 34*a*. The end 32*b* of the locking tongue 32 is adapted to clamp up the braid 11 within a recess 38 formed between the first leg portion 34*a* of the spring means 34 and a protruding portion 39 of the body 31. The protruding portion 39 has a surface 39*a* which inclines towards the first leg portion 34*a* so as to increase the clamping force exerted by the end 32*b* of the locking tongue 32 on the braid 11. One end 33*a* of the open groove 33 runs into the recess 38. The braid 11 will thus be clamped between the protruding portion 39 and the end 32*b* of the locking tongue 32. It is therefore possible to arrest the buckle 30 at any desired position along the braid 11 and thus to adjust the length of the second strap means 20 at any position along the braid 11.

When the respective buckle 30 is at or near the lower attachment point 14 of the first strap means 9 it is possible to securely position the head support 7 in the downwardly folded position by tightening the respective second strap means 20.

To make the adjustment of the length of the second strap means 20 more easy the longitudinal direction of the pin 50 forms an angle $\alpha$ of about 20° to about 60°, preferably about 30° to about 50°, and more preferably about 35° to about 45°, to the longitudinal direction of the open groove 33. By forming the pin 50 at such an angle to the open groove 33 the longitudinal direction of the pin 50 will be roughly normal to the longitudinal direction of the second strap means 20.

It should be noted that the buckle 30 also exists in a mirror-inverted form to the one shown in FIGS. 5 to 7.

The invention claimed is:

1. A baby carrier comprising chest straps, which are arranged to extend around both shoulder regions of a wearer, a waist belt, and a baby-carrying pouch mounted on the chest straps and the waist belt, said baby-carrying pouch comprises at least a front piece defining leg openings and a head support, a respective lateral corner of the head support being detachably connected to a corresponding nearby connecting point at a respective chest strap by a first strap means having a detachable buckle, wherein a second strap means is arranged between a respective lateral corner of the head support and a buckle slidably arranged along the respective first strap means, and said second strap means is continuously adjustably connected to said buckle.

2. The baby carrier according to claim 1, wherein the second strap means is arranged between a border portion of the respective lateral corner of the head support and the buckle.

3. The baby carrier according to claim 1, wherein said first strap means is provided with a braid along an edge of said first strap means, and that the buckle is slidably arranged along said braid.

4. The baby carrier according to claim 3, wherein said buckle is provided with a locking tongue arranged to lock said buckle to the braid at any point along said braid.

5. The baby carrier according to claim 3, wherein said braid is arranged along said edge of said first strap means directed away from a central portion of the baby carrier.

6. The baby carrier according to claim 1, wherein, said first strap means is attached at its end opposite to a detachable buckle to the head support in such a way that at least an upper attachment point and a lower attachment point are formed.

7. The baby carrier according to claim 6, wherein said head support is provided with a stiffening means arranged between an upper border edge of the head support and an imaginary line formed normal to the longitudinal direction of the front piece and between the respective upper attachment points and the respective lower attachment points.

8. The baby carrier according to claim 1, the buckle is slidably arranged along an edge of the first strap means.

9. The baby carrier according to claim 8, wherein said buckle is provided with a locking tongue arranged to lock said buckle at any point along said first strap means.

10. The baby carrier according to claim 8, wherein said buckle is adapted to slide along said edge of said first strap means directed away from a central portion of the baby carrier.

11. A buckle for enabling adjustment of the head support of the baby carrier according to claim 1, comprising a body provided with a locking tongue having a key portion, a pin around which a second strap means is continuously adjustably threaded, and an open grove in which a braid is arranged run, wherein the locking tongue is springingly attached to the body by a spring means and adapted to lock the buckle to the braid in any position along said braid.

12. The buckle according to claim 11, wherein an end of the locking tongue opposite to a key portion of the same has a flat surface arranged in parallel with a first leg portion of the spring means, and that said end of said locking tongue is adapted to clamp up the braid within a recess formed between said first leg portion of said spring means and a protruding portion formed at said body.

13. The buckle according to claim 11, wherein a longitudinal direction of the pin forms an angle of about 20° to about 60°, preferably about 30° to about 50°, and more preferably about 35° to about 45° to the longitudinal direction of the open groove.

* * * * *